US010393418B2

(12) United States Patent
Koge et al.

(10) Patent No.: US 10,393,418 B2
(45) Date of Patent: Aug. 27, 2019

(54) AIR-CONDITIONING APPARATUS

(71) Applicant: Mitsubishi Electric Corporation, Tokyo (JP)

(72) Inventors: Hirofumi Koge, Tokyo (JP); Koji Azuma, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 198 days.

(21) Appl. No.: 15/027,715

(22) PCT Filed: Dec. 25, 2013

(86) PCT No.: PCT/JP2013/084686

§ 371 (c)(1),
(2) Date: Apr. 7, 2016

(87) PCT Pub. No.: WO2015/097787

PCT Pub. Date: Jul. 2, 2015

(65) Prior Publication Data

US 2016/0245540 A1 Aug. 25, 2016

(51) Int. Cl.
*F25B 43/00* (2006.01)
*F25B 13/00* (2006.01)
(Continued)

(52) U.S. Cl.
CPC ..... *F25B 43/00* (2013.01); *F24F 3/06* (2013.01); *F24F 11/70* (2018.01); *F24F 11/83* (2018.01);
(Continued)

(58) Field of Classification Search
CPC ..... F24F 11/008; F24F 3/06; F24F 11/0076; F25B 43/006; F25B 43/00; F25B 13/00
See application file for complete search history.

(56) References Cited

U.S. PATENT DOCUMENTS 5,347,826 A * 9/1994 Hayashida ..... F24F 3/065 62/117
2012/0291460 A1* 11/2012 Aoyagi ..... F25B 47/025 62/79

FOREIGN PATENT DOCUMENTS

EP 1391660 A1 * 2/2004
JP H02230070 A * 9/1990
(Continued)

OTHER PUBLICATIONS

Osawa, Air Conditioner, Sep. 12, 1990, JPH02230070A, Whole Document.*
(Continued)

*Primary Examiner* — Larry L Furdge
(74) *Attorney, Agent, or Firm* — Posz Law Group, PLC

(57) ABSTRACT

An air-conditioning apparatus includes an outdoor unit, indoor units, and a relay unit, and forms a refrigerant circuit. The air-conditioning apparatus further includes a fourth flow control device that regulates the flow rate of refrigerant flowing into the heat source unit-side heat exchanger, a switching valve that regulates the flow rate of the refrigerant passing through a bypass pipe, and a control unit that controls the first heat-source-unit flow control device and the switching valve based on a pressure on a refrigerant inlet side of the heat source unit-side heat exchanger, an inlet temperature and an outlet temperature of a medium passing through the heat source unit-side heat exchanger, and the ratio of a cooling operation capacity to a heating operation capacity of the use-side heat exchangers.

7 Claims, 5 Drawing Sheets

(51) Int. Cl.

| | |
|---|---|
| ***F25B 49/02*** | (2006.01) |
| ***F24F 3/06*** | (2006.01) |
| ***F24F 11/70*** | (2018.01) |
| ***F24F 11/83*** | (2018.01) |
| *F24F 140/12* | (2018.01) |
| *F24F 11/84* | (2018.01) |
| *F24F 11/85* | (2018.01) |

(52) U.S. Cl.

CPC ..... *F25B 13/00* (2013.01); *F25B 43/006* (2013.01); *F25B 49/02* (2013.01); *F24F 11/84* (2018.01); *F24F 11/85* (2018.01); *F24F 2140/12* (2018.01); *F25B 2313/005* (2013.01); *F25B 2313/006* (2013.01); *F25B 2313/0231* (2013.01); *F25B 2313/0233* (2013.01); *F25B 2313/0252* (2013.01); *F25B 2313/0272* (2013.01); *F25B 2313/02741* (2013.01); *F25B 2313/0314* (2013.01); *F25B 2313/0315* (2013.01); *F25B 2400/13* (2013.01); *F25B 2400/23* (2013.01); *F25B 2600/2501* (2013.01); *F25B 2600/2509* (2013.01); *F25B 2600/2513* (2013.01); *F25B 2700/1931* (2013.01); *F25B 2700/1933* (2013.01)

(56) References Cited

FOREIGN PATENT DOCUMENTS

| | | | | |
|---|---|---|---|---|
| JP | H03129259 | A | * | 6/1991 |
| JP | 07-234037 | A | | 9/1995 |
| JP | 2522361 | B2 | | 8/1996 |
| JP | 11-230630 | A | | 8/1999 |
| JP | 2004-020191 | A | | 1/2004 |
| JP | 2004347148 | A | * | 12/2004 |
| JP | 2008051425 | A | * | 3/2008 |
| JP | 2010096479 | A | * | 4/2010 |
| WO | 2013/111176 | A1 | | 8/2013 |
| WO | 2013/144994 | A1 | | 10/2013 |

OTHER PUBLICATIONS

Kunimoto et al., Heat Pump Hot Water Supply Device, Dec. 9, 2004, JP2004347148A, Whole Document.*

Odajima, Air Conditioner, Apr. 30, 2010, JP2010096479A, Whole Document.*

Kitayama et al., Multi-Room Type Air Conditioner, Jun. 3, 1991, JPH03129259A, Whole Document.*

Park et al., Multi Unit Air Conditioner and Method for Controlling Operation of Outdoor Unit Fan thereof, Feb. 25, 2004, EP1391660A1, Whole Document.*

Kusaka et al., Air Conditioner, Mar. 6, 2008, JP2008051425A, Whole Document.*

International Search Report of the International Searching Authority dated Mar. 25, 2014 for the corresponding international application No. PCT/JP2013/084686 (and English translation).

Extended European Search Report dated Jul. 11, 2017 issued in corresponding EP application No. 13900163.0.

Office Action dated Mar. 14, 2017 issued in the corresponding JP application No. 2015-554364 (and English translation).

* cited by examiner

AIR-CONDITIONING APPARATUS

CROSS REFERENCE TO RELATED APPLICATION

This application is a U.S. national stage application of International Application No. PCT/JP2013/084686 filed on Dec. 25, 2013, the disclosure of which is incorporated herein by reference.

TECHNICAL FIELD

The present invention relates to an air-conditioning apparatus that includes a plurality of indoor units connected therein and enables each of the indoor units to perform cooling or heating selectively or enables the indoor units to perform cooling or heating simultaneously.

BACKGROUND ART

A typical air-conditioning apparatus using a refrigeration cycle (heat pump cycle) includes a compressor, a heat source unit (heat source device, outdoor unit) including a heat source unit-side heat exchanger, a flow control device (such as an expansion valve), and a load side unit (indoor unit) including an indoor unit-side heat exchanger connected by refrigerant pipes to form a refrigerant circuit through which refrigerant is circulated. In the indoor unit-side heat exchanger, when evaporating or condensing, the refrigerant removes heat from or transfers heat to air, serving as a heat exchange target, in an air-conditioned space. Such a phenomenon is used to condition the air while changing, for example, a pressure and a temperature related to the refrigerant in the refrigerant circuit.

In this case, for example, there is proposed an air-conditioning apparatus capable of performing a simultaneous cooling and heating operation (cooling and heating mixed operation) in which whether to perform cooling or heating automatically determined for each of a plurality of indoor units in accordance with a temperature set by a remote controller and the like provided to the indoor unit and an air temperature around the indoor unit, thereby being capable of performing cooling and heating by each indoor unit (for example, refer to Patent Literature 1).

CITATION LIST

Patent Literature

Patent Literature 1: Japanese Patent No. 2522361 B2

SUMMARY OF INVENTION

Technical Problem

Known methods for reducing a conductance (AK value=heat transfer area A[$m^2$]×overall heat transfer coefficient K [$W/m^2$]), serving as a heat exchange capacity of the heat exchanger in control of the capacity of a heat exchanger, include a method of reducing the flow rate of air through a fan if the heat exchanger is an air heat exchanger, a method of dividing the heat exchanger into segments to reduce the heat transfer area A, a method of allowing the refrigerant to flow so as to bypass the heat exchanger, and the like.

The air-conditioning apparatus, which is capable of performing the simultaneous cooling and heating operation, disclosed in Patent Literature 1 can also perform a heat recovery operation (in which heat in an indoor space subjected to cooling is used for heating) for the indoor units. When an air-conditioning load for cooling is substantially equal to an air-conditioning load for heating and a full heat recovery operation is performed, the amount of heat exchange in an outdoor heat exchanger has to be reduced. Specifically, to improve comfort performance and energy-saving performance of the air-conditioning apparatus in the heat recovery operation, the radiated heat quantity in the outdoor heat exchanger in a cooling main operation has to be brought close to zero and the absorbed heat quantity in the outdoor heat exchanger in a heating main operation has to be brought close to zero.

In view of the reliability of a compressor, since the compression ratio has to be kept at or above a predetermined value (e.g., at or above 2), the AK value has to be reduced under conditions where outdoor air has a low temperature or the compressor operates at a low capacity in a cooling operation. If the heat exchanger is an air heat exchanger, the flow rate of air through an outdoor fan has to be kept at or above a predetermined value to cool an electronic circuit board of an outdoor unit. If the heat exchanger is a water heat exchanger, the flow velocity of water has to be kept at or above a predetermined value to prevent pitting corrosion. It is therefore difficult to reduce the AK value to a desired value. This results in a reduction in low-pressure side pressure in a refrigerant circuit.

In an indoor unit performing the cooling operation, an evaporating temperature has to be kept at or above 0 degrees C. to prevent moisture in the air in a use-side heat exchanger from freezing. Nevertheless, if pressure of the low-pressure side in the refrigerant circuit decreases and the evaporating temperature in the use-side heat exchanger fails to remain at or above 0 degrees C., the operation may have to be stopped. Because of this, there is a problem that the indoor unit frequently switches between on and off states (on/off switching), leading to a loss of comfort in an indoor space, a deterioration of energy-saving performance, and the like.

The present invention has been made to solve the above-described disadvantages and is directed to an air-conditioning apparatus that enables appropriate control in the simultaneous cooling and heating operation.

Solution to Problem

The present invention provides an air-conditioning apparatus including an outdoor unit that includes a compressor compressing and discharging the refrigerant, a heat source unit-side heat exchanger exchanging heat between the refrigerant and a medium, and a four-way valve switching between refrigerant passages, a plurality of indoor units each including a plurality of use-side heat exchangers exchanging heat between the refrigerant and air to be conditioned and a plurality of indoor expansion devices reducing the pressure of the refrigerant, and a relay unit that is connected between the outdoor unit and the indoor units and provides a passage through which gas refrigerant is supplied to at least one indoor unit performing heating of the indoor units and a passage through which liquid refrigerant is supplied to at least one indoor unit performing cooling of the indoor units. The outdoor unit, the plurality of indoor units, and the relay unit are connected by pipes to form a refrigerant circuit. The air-conditioning apparatus further includes a heat-source-unit flow control device regulating the flow rate of the refrigerant flowing into the heat source unit-side heat exchanger, a bypass pipe allowing the refrigerant to bypass the heat source unit-side heat exchanger, a switching device regulating the flow rate of the refrigerant passing through the bypass pipe, and a controller. The controller obtains a target control temperature for the heat source unit-side heat exchanger based on a pressure on a refrigerant inlet side of the heat source unit-side heat exchanger, an inlet temperature and an outlet temperature of the medium passing through the heat source unit-side heat exchanger, and the ratio of a cooling operation capacity to a heating operation capacity of the use-side heat exchangers, and controls the flow control device and the switching device based on the target control temperature.

Advantageous Effects of Invention

According to the present invention, while the controller controls the flow control device and the switching device to control the flow rate of the refrigerant flowing through the heat source unit-side heat exchanger, the simultaneous cooling and heating operation is performed. This can prevent on/off switching of the indoor unit performing cooling and a reduction in heating capacity.

DESCRIPTION OF EMBODIMENTS

Figure 1:
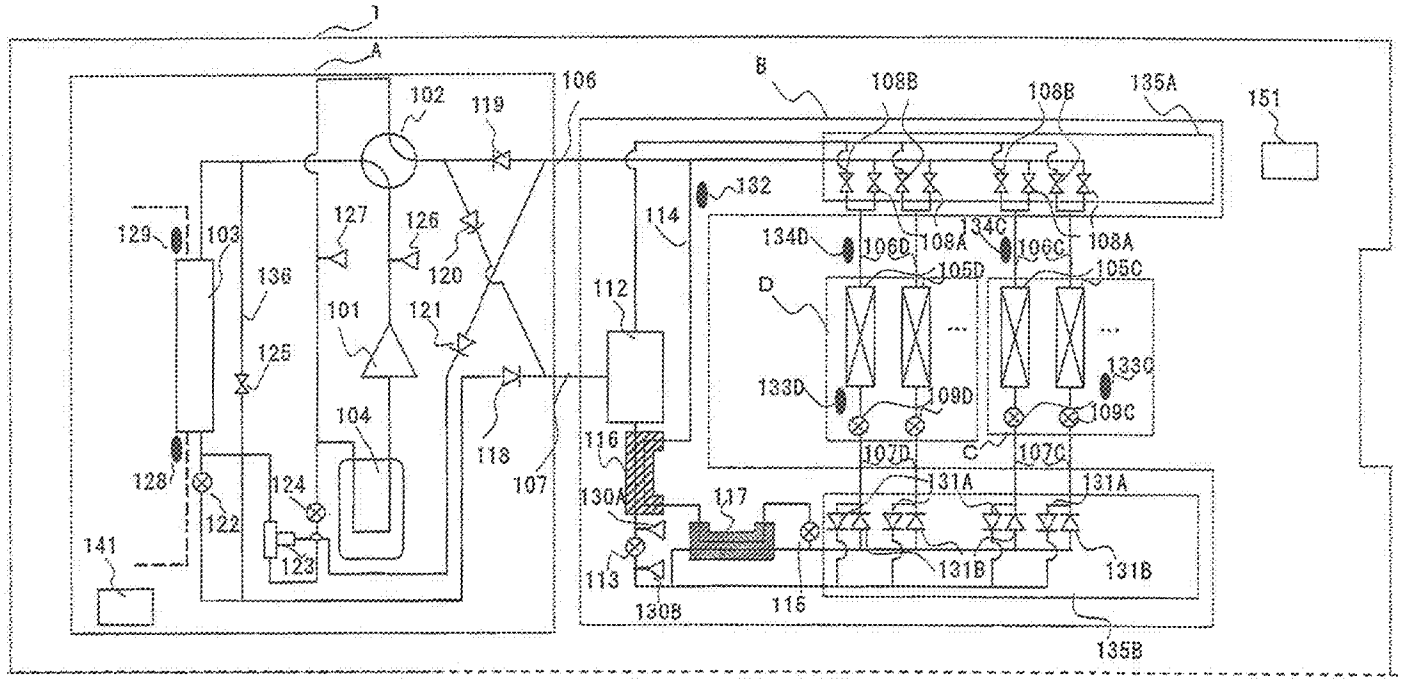
FIG. 1 is a diagram illustrating an exemplary configuration of an air-conditioning apparatus 1 according to Embodiment of the present invention.

An air-conditioning apparatus according to Embodiment of the present invention will be described with reference to the drawings. In the drawings below, the same reference numerals indicate the same or corresponding elements, and this applies throughout the present specification. In addition, the forms of the elements described throughout the present specification are merely illustrative, and the present invention is not limited to the description of the specification. In particular, combination patterns of the components are not intended to be limited to those in Embodiments. A component in one Embodiment can be applied to another Embodiment. In addition, the term "upward" refers to the upward direction in the drawings and the term "downward" refers to the downward direction in the drawings. Furthermore, if a plurality of devices of the same type distinguished from one another using subscripts do not have to be distinguished from one another or specified, the subscripts may be omitted. Furthermore, in the drawings, the dimensional relationships among components may differ from the actual ones.

Embodiment

FIG. 1 is a diagram illustrating an exemplary configuration of an air-conditioning apparatus 1 according to Embodiment of the present invention. As illustrated in FIG. 1, the air-conditioning apparatus 1 includes a heat source unit (outdoor unit) A, an indoor unit C, an indoor unit D, a relay unit B, and the like. The air-conditioning apparatus 1 is capable of performing a simultaneous cooling and heating operation because a refrigerant circuit for cooling and a refrigerant circuit for heating can be formed simultaneously in the air-conditioning apparatus 1.

When a cooling operation capacity and a heating operation capacity change in the cooling and heating simultaneous operation, a control is performed for the heat source unit A, based on, for example, temperatures related to the heat source unit A detected by a first pressure detecting device 126, a second pressure detecting device 127, an inlet temperature detecting device 128, and an outlet temperature detecting device 129, which are provided to the heat source unit A. This control regulates, within a certain range, the temperatures (liquid pipe temperatures) of the refrigerant flowing to respective use-side heat exchangers 105 provided to the indoor units C and D. Thus, if the cooling operation capacity and the heating operation capacity change in the simultaneous cooling and heating operation, the simultaneous cooling and heating operation can be stably continued at a low cost (details thereof are described later).

The relay unit B intervenes between the heat source unit A and each of the indoor unit C and the indoor unit D. The heat source unit A is connected to the relay unit B by a first connecting pipe 106 and a second connecting pipe 107 having a smaller diameter than the first connecting pipe 106. The relay unit B is connected to the indoor unit C by first connecting pipes 106C and second connecting pipes 107C. In addition, the relay unit B is connected to the indoor unit D by first connecting pipes 106D and second connecting pipes 107D. With the above described connection configuration, the relay unit B relays the refrigerant flowing between the heat source unit A and each of the indoor unit C and the indoor unit D. The configuration, components, and the like of the relay unit B will be described later.

In the Embodiment, although the example in which the single heat source unit A, the two indoor units C and the two indoor units D are arranged are described, the number of heat source units and the number of indoor units are not particularly limited. For example, two or more indoor units C and D may be arranged. For example, a plurality of heat source units A may be arranged. Furthermore, for example, a plurality of relay units B may be arranged.

The heat source unit A includes a compressor 101, a four-way valve 102, a heat source unit-side heat exchanger 103, and an accumulator 104. The heat source unit A further includes check valves 118, 119, 120, and 121. In addition, the heat source unit A includes a fourth flow control device 122, a gas-liquid separator 123, a fifth flow control device 124, a switching valve 125, and a control unit 141. Additionally, the heat source unit A includes the first pressure detecting device 126, the second pressure detecting device 127, the inlet temperature detecting device 128, and the outlet temperature detecting device 129. Each of these detecting devices detects and measures a pressure or a temperature and supplies the result of measurement to the control unit 141.

The compressor 101 is disposed between the four-way valve 102 and the accumulator 104. The compressor 101 compresses the refrigerant and discharges the compressed refrigerant. A discharge side of the compressor 101 is connected to the four-way valve 102 and a suction side of the compressor 101 is connected to the accumulator 104.

The four-way valve 102 has four ports. The ports of the four-way valve 102 are connected to the discharge side of the compressor 101, the heat source unit-side heat exchanger 103, the accumulator 104, an outlet side of the check valve 119, and an inlet side of the check valve 120. The four-way valve 102 switches between refrigerant passages.

The heat source unit-side heat exchanger 103 is disposed between the four-way valve 102 and a point between the fourth flow control device 122 and the gas-liquid separator 123. The heat source unit-side heat exchanger 103 is connected at a first end to the four-way valve 102 and is connected at a second end to a pipe connecting to the fourth flow control device 122 and the gas-liquid separator 123. The switching valve 125, serving as a switching device, is an openable and closable valve that regulates the flow rate of the refrigerant passing through a bypass pipe 136 to bypass the heat source unit-side heat exchanger 103. The switching valve 125 is connected at a first end to an inlet side of the heat source unit-side heat exchanger 103 and is connected at a second end to an outlet side of the fourth flow control device 122. The heat source unit-side heat exchanger 103 exchanges heat between the refrigerant flowing through the heat source unit-side heat exchanger 103 and a medium (in this case, for example, water) flowing through the heat source unit-side heat exchanger 103. For the medium flowing through the heat source unit-side heat exchanger 103, brine may be used.

The accumulator 104, which is connected between the four-way valve 102 and the suction side of the compressor 101, separates the refrigerant into liquid refrigerant and gas refrigerant, and supplies the gas refrigerant to the compressor 101. The fifth flow control device 124, which is connected between the accumulator 104 and the gas-liquid separator 123, regulates the refrigerant flowing into the heat source unit-side heat exchanger 103.

The compressor 101, the four-way valve 102, and the heat source unit-side heat exchanger 103 described above are some of main components of a refrigerant circuit.

The check valve 118 is disposed between the fourth flow control device 122 connected to the heat source unit-side heat exchanger 103 and a point between the second connecting pipe 107 and an outlet side of the check valve 120. An inlet side of the check valve 118 is connected to a pipe connecting to the fourth flow control device 122. An outlet side of the check valve 118 is connected to a pipe connecting to the second connecting pipe 107 and the outlet side of the check valve 120. The check valve 118 permits the refrigerant to flow in only one direction from the heat source unit-side heat exchanger 103 to the second connecting pipe 107 through the fourth flow control device 122.

The check valve 119 is disposed between a point between the four-way valve 102 and the inlet side of the check valve 120 and a point between the first connecting pipe 106 and an inlet side of the check valve 121. An inlet side of the check valve 119 is connected to a pipe connecting to the first connecting pipe 106 and the inlet side of the check valve 121. The outlet side of the check valve 119 is connected to a pipe connecting to the four-way valve 102 and the inlet side of the check valve 120. The check valve 119 permits the refrigerant to flow in only one direction from the first connecting pipe 106 to the four-way valve 102.

The check valve 120 is disposed between the point between the four-way valve 102 and the outlet side of the check valve 119 and the point between the outlet side of the check valve 118 and the second connecting pipe 107. The inlet side of the check valve 120 is connected to the pipe connecting to the four-way valve 102 and the outlet side of the check valve 119. The outlet side of the check valve 120 is connected to the pipe connecting to the outlet side of the check valve 118 and the second connecting pipe 107. The check valve 120 permits the refrigerant to flow in only one direction from the four-way valve 102 to the second connecting pipe 107.

The check valve 121 is disposed between the gas-liquid separator 123 connected to the heat source unit-side heat exchanger 103 and the point between the inlet side of the check valve 119 and the first connecting pipe 106. The inlet side of the check valve 121 is connected to the pipe connecting to the inlet side of the check valve 119 and the first connecting pipe 106. An outlet side of the check valve 121 is connected to a pipe connecting to the gas-liquid separator 123. The check valve 121 permits the refrigerant to flow in only one direction from the first connecting pipe 106 to the gas-liquid separator 123.

The above-described check valves 118 to 121 constitute a flow switching valve of the refrigerant circuit. This flow switching valve, the relay unit B, which will be described in detail later, the indoor unit C, and the indoor unit D form a refrigeration cycle for a cooling operation and a refrigeration cycle for a heating operation as refrigerant circuits during the simultaneous cooling and heating operation.

The fourth flow control device 122, serving as a first heat-source-unit flow control device, is connected at a first end to the inlet side of the check valve 118, and is connected at a second end to the point between the heat source unit-side heat exchanger 103 and the outlet side of the gas-liquid separator 123. The outlet side of the check valve 118 is connected to a first end of the second connecting pipe 107. The second connecting pipe 107 is connected at a second end to the relay unit B. The switching valve 125, serving as a switching device, is connected at the first end to the heat source unit-side heat exchanger 103, and is connected at the second end to the fourth flow control device 122.

With this connection configuration, the fourth flow control device 122 and the switching valve 125 are connected in series with the relay unit B and the refrigerant is supplied to the relay unit B. The fourth flow control device 122 is a flow control device having a variable opening degree.

Accordingly, by regulating the opening degree of the fourth flow control device 122, the flow rate of the refrigerant flowing into the heat source unit-side heat exchanger 103 is controlled. The refrigerant at the controlled flow rate merges with a stream of refrigerant flowing through the switching valve 125, and is then supplied to the relay unit B.

The fifth flow control device 124, serving as a second heat-source-unit flow control device, is disposed between the gas-liquid separator 123 and the accumulator 104. The fifth flow control device 124 is connected at a first end to a first outlet side of the gas-liquid separator 123, and is connected at a second end to an inlet side of the accumulator 104. A second outlet side of the gas-liquid separator 123 is connected to the heat source unit-side heat exchanger 103. An inlet side of the gas-liquid separator 123 is connected to the check valve 121. The inlet side of the check valve 121 is connected to a first end of the first connecting pipe 106. The first connecting pipe 106 is connected at a second end to the relay unit B. The gas-liquid separator 123 may be composed of a T-shaped pipe and the like.

With this connection configuration, the fifth flow control device 124 and the heat source unit-side heat exchanger 103 are connected in series with the relay unit B, and the refrigerant is supplied from the relay unit B. The fifth flow control device 124 is a flow control device having a variable opening degree. Accordingly, by regulating the opening degree of the fifth flow control device 124, the flow rate of the refrigerant flowing from the relay unit B is controlled. The refrigerant can be supplied at the controlled flow rate to the heat source unit-side heat exchanger 103.

The control unit 141 serving as a controller includes, for example, a microprocessor unit including such as a central processing unit (CPU), a memory (storage unit), and the like (not illustrated) as a main component. The control unit 141 controls the heat source unit A in a centralized manner, by, for example, communicating with the relay unit B or other external devices, and performing various arithmetic operations. The control unit 141 may control the entire air-conditioning apparatus 1. During cooling in the Embodiment, the control unit 141 controls the fourth flow control device 122 and the switching valve 125 to control the flow rate of the refrigerant flowing through the heat source unit-side heat exchanger 103. During heating, the control unit 141 controls the fifth flow control device 124 to control the flow rate of the refrigerant (particularly, the liquid refrigerant) flowing into the heat source unit-side heat exchanger 103.

The first pressure detecting device 126 and the second pressure detecting device 127 each include a sensor and the like. The first pressure detecting device 126 detects the pressure of the refrigerant discharged from the compressor 101. The second pressure detecting device 127 detects the pressure of the refrigerant on a refrigerant outlet side of the heat source unit-side heat exchanger 103. Each of the first pressure detecting device 126 and the second pressure detecting device 127 transmits a signal indicative of the detected pressure to the control unit 141. Each of the first pressure detecting device 126 and the second pressure detecting device 127 may transmit a signal indicative of the detected pressure as it is to the control unit 141. For example, each of these detecting devices may include a storage unit, accumulate detected pressures as data for a predetermined period of time, and transmit a signal containing the data indicative of the pressures to the control unit 141 at predetermined time intervals. Each of the first pressure detecting device 126 and the second pressure detecting device 127 may be, but not limited to, a component including a sensor and the like as described above.

The inlet temperature detecting device 128 and the outlet temperature detecting device 129 each include a thermistor and the like. The inlet temperature detecting device 128 detects the temperature (inlet temperature) of the water flowing into the heat source unit-side heat exchanger 103. The outlet temperature detecting device 129 detects the temperature (outlet temperature) of the water flowing out of the heat source unit-side heat exchanger 103. Each of the inlet temperature detecting device 128 and the outlet temperature detecting device 129 transmits a signal indicative of the detected temperature to the control unit 141. Each of the inlet temperature detecting device 128 and the outlet temperature detecting device 129 may transmit a signal indicative of the detected temperature as it is to the control unit 141. For example, each of these detecting devices may include a storage unit, accumulate detected temperatures as data for a predetermined period of time, and transmit a signal containing the data indicative of the temperatures to the control unit 141 at predetermined time intervals. Although the inlet temperature detecting device 128 and the outlet temperature detecting device 129 each including a thermistor etc, are described as an example, each of these detecting devices may be any other temperature detecting device, such as an infrared sensor and the like.

The relay unit B includes a merging unit 135A, a merging unit 135B, a gas-liquid separator 112, a second flow control device 113, a third flow control device 115, a first heat exchanger 116, a second heat exchanger 117, a relay unit temperature detecting device 132, a third pressure detecting device 130A, a fourth pressure detecting device 130B, a control unit 151, and the like. The relay unit B is connected to the heat source unit A by the first connecting pipe 106 and the second connecting pipe 107. The relay unit B is connected to the indoor unit C by the first connecting pipes 106C and the second connecting pipes 107C. The relay unit B is connected to the indoor unit D by the first connecting pipes 106D and the second connecting pipes 107C.

The merging unit 135A includes first solenoid valves 108A and second solenoid valves 108B. The first solenoid valves 108A and the second solenoid valves 108B are connected to the indoor unit C by the first connecting pipes 106C. The first solenoid valves 108A and the second solenoid valves 108B are connected to the indoor unit D by the first connecting pipes 106D. The first solenoid valves 108A, which are openable and closable valves, are connected at one end to the first connecting pipe 106, and are connected at the other end to the first connecting pipes 106C, the first connecting pipes 106D, and first terminals of the second solenoid valves 108B. The second solenoid valves 108B, which are openable and closable valves, are connected at one end to the second connecting pipe 107, and are connected at the other end to the first connecting pipes 106C, the first connecting pipes 106D, and first terminals of the first solenoid valves 108A.

The merging unit 135A is connected to the indoor unit C by the first connecting pipes 106C. The merging unit 135A is connected to the indoor unit D by the first connecting pipes 106D. The merging unit 135A is connected to the heat source unit A by the first connecting pipe 106 and the second connecting pipe 107. In the merging unit 135A, the first connecting pipes 106C are connected to one of the first connecting pipe 106 and the second connecting pipe 107 by using the first solenoid valves 108A and the second solenoid valves 108B. In the merging unit 135A, the first connecting pipes 106D are connected to one of the first connecting pipe 106 and the second connecting pipe 107 by using the first solenoid valves 108A and the second solenoid valves 108B.

The merging unit 135B includes check valves 131A and check valves 131B. The check valves 131A are connected in antiparallel with the check valves 131B. Inlet sides of the check valves 131A and outlet sides of the check valves 131B are connected to the indoor unit C by the second connecting pipes 107C, and are connected to the indoor unit D by the second connecting pipes 107D. Outlet sides of the check valves 131A are connected to the merging unit 135A. Inlet sides of the check valves 131B are connected to the merging unit 135B.

The merging unit 135B is connected to the indoor unit C by the second connecting pipes 107C. The merging unit 135B is connected to the indoor unit D by the second connecting pipes 107D.

The gas-liquid separator 112 is disposed at a position in the middle of the second connecting pipe 107. The gas-liquid separator 112 includes a gas phase portion and a liquid phase portion. The gas phase portion is connected to the second solenoid valves 108B in the merging unit 135A. The liquid phase portion is connected to the merging unit 135B through the first heat exchanger 116, the second flow control device 113, the second heat exchanger 117, and the third flow control device 115.

The second flow control device 113 is connected at a first end to the first heat exchanger 116, and is connected at a second end to a first end of the second heat exchanger 117 and the merging unit 135B. The third pressure detecting device 130A, which will be described in detail later, is disposed in a pipe connecting the first heat exchanger 116 to the second flow control device 113. The fourth pressure detecting device 130B, which will be described in detail later, is disposed in a pipe connecting the second flow control device 113 to the second heat exchanger 117 and the merging unit 135A. The second flow control device 113 is a flow controller having a controllable opening degree. The opening degree of the second flow control device 113 is controlled so that the difference between a pressure detected by the third pressure detecting device 130A and a pressure detected by the fourth pressure detecting device 130B is fixed.

The third flow control device 115 is connected at a first side to a bypass pipe 114 extending through the second heat exchanger 117, and is connected at a second side to a pipe connecting the second heat exchanger 117 to the merging unit 135B. The third flow control device 115 is a flow controller having a controllable opening degree. The opening degree of the third flow control device 115 is controlled by any one or a combination of at least two of the relay unit temperature detecting device 132, the third pressure detecting device 130A, and the fourth pressure detecting device 130B. The bypass pipe 114 is connected at a first end to the first connecting pipe 106, and is connected at a second end to the third flow control device 115. The amount of refrigerant supplied to the heat source unit A accordingly depends on the opening degree of the third flow control device 115.

The first heat exchanger 116 is disposed between the gas-liquid separator 112 and each of the second heat exchanger 117 and the second flow control device 113. The first heat exchanger 116 exchanges heat between the bypass pipe 114 and the pipe disposed between the gas-liquid separator 112 and the second flow control device 113.

The second heat exchanger 117 is disposed between each of the first heat exchanger 116 and the second flow control device 113 and each of the first and second ends of the third flow control device 115. The second end of the third flow control device 115 is connected to the merging unit 135B. The second heat exchanger 117 exchanges heat between the bypass pipe 114 and the pipe disposed between the second flow control device 113 and the third flow control device 115.

The relay unit temperature detecting device 132 is, for example, a thermistor. The relay unit temperature detecting device 132 measures the temperature of the refrigerant flowing from an outlet of the second heat exchanger 117, that is, the refrigerant flowing through the pipe disposed downstream of the second heat exchanger 117, and supplies the result of measurement to the control unit 151. The relay unit temperature detecting device 132 may supply a measurement result as it is to the control unit 151, or may accumulate measurement results for a predetermined period of time and supply the accumulated measurement results to the control unit 151 at predetermined time intervals. The relay unit temperature detecting device 132 may be, but not limited to, a thermistor as described above.

The third pressure detecting device 130A measures the pressure of the refrigerant flowing through the pipe disposed between the first heat exchanger 116 and the second flow control device 113, and supplies the result of measurement to the control unit 151. The fourth pressure detecting device 130B measures the pressure of the refrigerant flowing through the pipe connecting the second flow control device 113 to the second heat exchanger 117 and the merging unit 135B, and supplies the result of measurement to the control unit 151. Each of the third pressure detecting device 130A and the fourth pressure detecting device 130B may supply a measurement result as it is to the control unit 151 or may accumulate measurement results for a predetermined period of time and supply the accumulated measurement results to the control unit 151 at predetermined time intervals.

The control unit 151 includes, for example, a microprocessor unit including a central processing unit (CPU), a memory (storage unit), and the like (not illustrated) as a main component. The control unit 151 controls the relay unit B in a centralized manner, by, for example, communicating with the heat source unit A or other external devices, and performing various arithmetic operations.

The indoor unit C includes use-side heat exchangers 105C, a liquid pipe temperature detecting device 133C, a gas pipe temperature detecting device 134C, first flow control devices 109C, and the like. A plurality of use-side heat exchangers 105C are arranged. The liquid pipe temperature detecting device 133C for detecting a pipe temperature is disposed between the use-side heat exchangers 105C and the first flow control devices 109C. In addition, the gas pipe temperature detecting device 134C for detecting a pipe temperature is disposed between the use-side heat exchangers 105C and the merging unit 135A.

The use-side heat exchangers 105C and the first flow control devices 109C described above are parts of the refrigerant circuit.

The indoor unit D includes use-side heat exchangers 105D, a liquid pipe temperature detecting device 133D, a gas pipe temperature detecting device 134D, first flow control devices 109D, and the like. A plurality of use-side heat exchangers 105D are arranged. The liquid pipe temperature detecting device 133D for detecting a pipe temperature is disposed between the use-side heat exchangers 105D and the first flow control devices 109D. In addition, the gas pipe temperature detecting device 134D for detecting a pipe temperature is disposed between the use-side heat exchangers 105D and the merging unit 135A. The use-side heat exchangers 105D and the first flow control devices 109D described above are parts of the refrigerant circuit.

Figure 2:
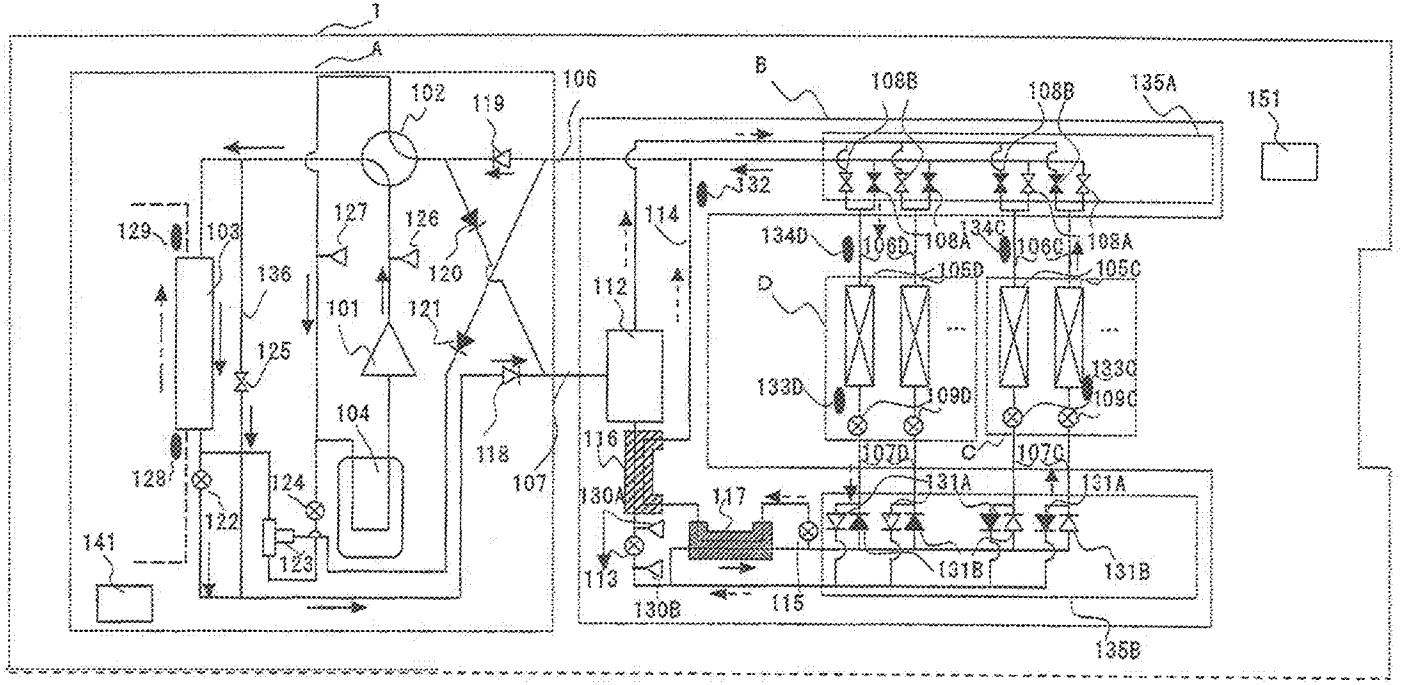
FIG. 2 is a diagram explaining an operation state in a cooling main operation included in a simultaneous cooling and heating operation in Embodiment of the present invention.

FIG. 2 is a diagram explaining an operation state in the cooling main operation included in the simultaneous cooling and heating operation in Embodiment of the present invention. It is assumed that the indoor unit C is set to perform the cooling operation, the indoor unit D is set to perform the heating operation, and the air-conditioning apparatus 1 is operated in the cooling main operation. In FIG. 2, full-line arrows indicate a main refrigerant flow direction in the cooling main operation, dotted-line arrows indicate a refrigerant flow direction mainly related to heating, and an alternate long and short dash line indicates a water flow direction.

The first solenoid valves 108A connected to the indoor unit C are opened so that the refrigerant is allowed to pass through the valves. The first solenoid valves 108A connected to the indoor unit D are closed so that the refrigerant is not allowed to pass through the valves (in FIG. 2, the valves through which the refrigerant is not allowed to pass are illustrated as filled marks; the same applies to FIG. 3 described below). In addition, the second solenoid valves 108B connected to the indoor unit C are closed and the second solenoid valves 108B connected to the indoor unit D are opened. The opening degree of the second flow control device 113 is controlled so that the difference between a pressure detected by the third pressure detecting device 130A and a pressure detected by the fourth pressure detecting device 130B is a proper value.

Flows of the refrigerant will now be described. As indicated by the full-line arrows, a high temperature, high pressure gas refrigerant, compressed and discharged by the compressor 101, passes through the four-way valve 102 and then flows into the heat source unit-side heat exchanger 103. The heat source unit-side heat exchanger 103 exchanges heat between the refrigerant and the water, as a medium, so that the high temperature, high pressure gas refrigerant subjected to heat exchange turns into a high temperature, high pressure, two-phase gas-liquid refrigerant. The high temperature, high pressure, two-phase gas-liquid refrigerant passes through the fourth flow control device 122, the check valve 118, and the second connecting pipe 107, and is then supplied to the gas-liquid separator 112 in the relay unit B. At this time, the control unit 141 controls the switching valve 125 based on the difference between a pressure detected by the first pressure detecting device 126 and a target value so that the switching valve 125 has a predetermined opening degree.

The gas-liquid separator 112 separates the high temperature, high pressure, two-phase gas-liquid refrigerant into the gas refrigerant and the liquid refrigerant. The separated gas refrigerant flows into the merging unit 135A. The gas refrigerant that has flowed into the merging unit 135A is supplied through the opened second solenoid valves 108B and the first connecting pipes 106D to the indoor unit D, which is set for the heating operation.

In the indoor unit D, the use-side heat exchangers 105D exchange heat between the refrigerant and a target to be conditioned, such as air, so that the supplied gas refrigerant condenses and liquefies. Furthermore, the first flow control devices 109D control the use-side heat exchangers 105D based on the degree of subcooling at outlets of the use-side heat exchangers 105D.

The first flow control devices 109D reduce the pressure of the liquid refrigerant, condensed and liquefied in the use-side heat exchangers 105D, so that the refrigerant turns into intermediate pressure refrigerant having intermediate pressure between a high pressure and a low pressure. The intermediate pressure refrigerant is allowed to flow into the merging unit 135B.

At this time, the first connecting pipe 106 is at the low pressure and the second connecting pipe 107 is at the high pressure. The difference in pressure between these pipes causes the refrigerant to flow through the check valves 118 and 119. The refrigerant does not flow through the check valves 120 and 121.

On the other hand, the liquid refrigerant, separated by the gas-liquid separator 112, passes through the second flow control device 113 performing control so that the difference between the high pressure and the intermediate pressure is fixed, and then flows into the merging unit 135B. In the merging unit 135B, the supplied liquid refrigerant passes through the check valves 131B connected to the indoor unit C and then flows into the indoor unit C. After that, the liquid refrigerant that has flowed into the indoor unit C is reduced to the low pressure by the first flow control devices 109C, which are controlled based on the degree of superheat at outlets of the use-side heat exchangers 105C in the indoor unit C. The refrigerant is then supplied to the use-side heat exchangers 105C.

In the use-side heat exchangers 105C, the supplied liquid refrigerant exchanges heat with, for example, air to be conditioned, so that the refrigerant evaporates and gasifies. The gasified, or the gas refrigerant passes through the first connecting pipes 106C and then flows into the merging unit 135A. In the merging unit 135A, the first solenoid valves 108A connected to the indoor unit C are opened. Thus, the gas refrigerant that has flowed into the merging unit 135A passes through the first solenoid valves 108A connected to the indoor unit C and then flows into the first connecting pipe 106.

After that, the gas refrigerant flows into the check valve 119, which is at a lower pressure than the check valve 121, and passes through the four-way valve 102 and the accumulator 104. The refrigerant is then sucked into the compressor 101. Such an operation forms the refrigeration cycles to perform the cooling main operation.

Part of the liquid refrigerant, separated by the gas-liquid separator 112, flowing to the merging unit 135B does not flow to the indoor unit C. This part of the liquid refrigerant passes through the second flow control device 113, flows through the second heat exchanger 117, and then flows into the third flow control device 115 without flowing into the merging unit 135B. The third flow control device 115 reduces the pressure of the liquid refrigerant, which has flowed into the third flow control device 115, to the low pressure, thus reducing the evaporating temperature of the refrigerant. In the second heat exchanger 117, the liquid refrigerant, reduced in evaporating temperature, passing through the bypass pipe 114 exchanges heat with the liquid refrigerant mainly supplied from the second flow control device 113, and thus turns into the two-phase gas-liquid refrigerant. In the first heat exchanger 116, the two-phase gas-liquid refrigerant exchanges heat with the high temperature, high pressure liquid refrigerant supplied from the gas-liquid separator 112, so that the two-phase gas-liquid refrigerant turns into the gas refrigerant. The refrigerant then flows into the first connecting pipe 106.

Figure 3:
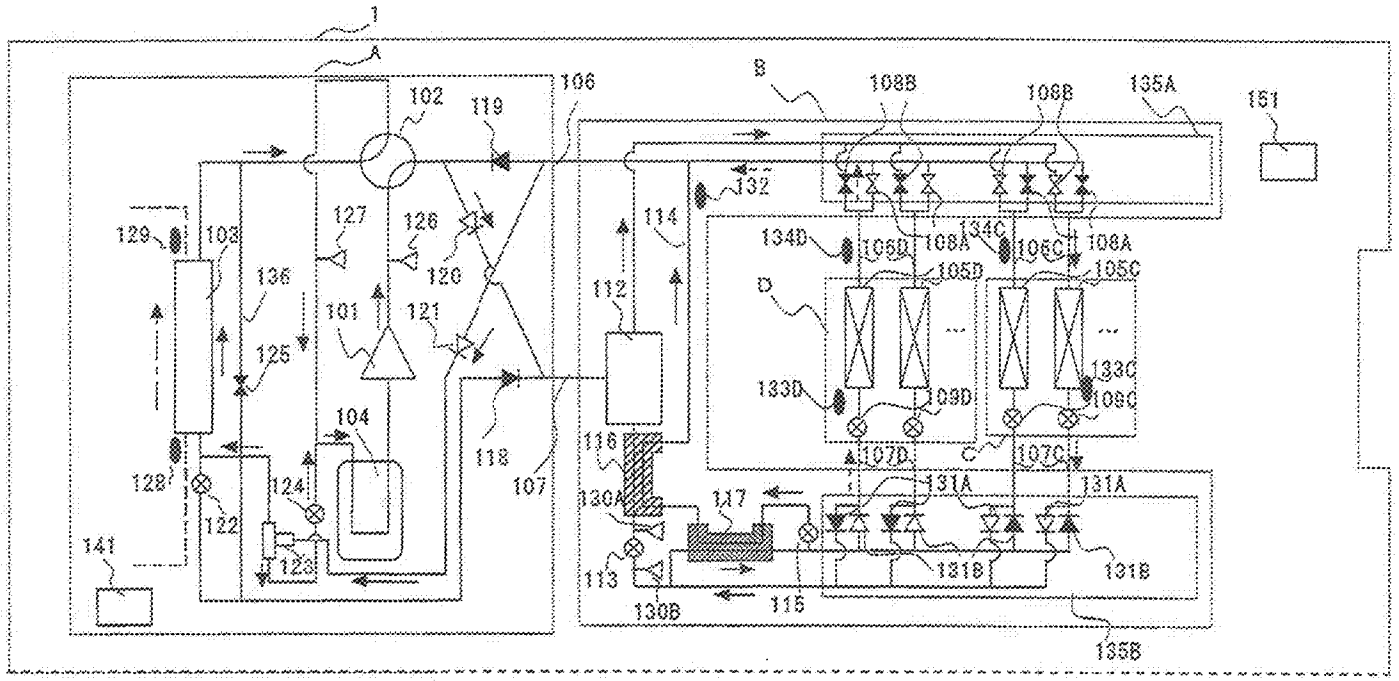
FIG. 3 is a diagram explaining an operation state in a heating main operation included in the simultaneous cooling and heating operation in Embodiment of the present invention.

FIG. 3 is a diagram explaining an operation state in the heating main operation included in the simultaneous cooling and heating operation in Embodiment of the present invention. It is assumed that the indoor unit C is set to perform the heating operation, the indoor unit D is set to perform the cooling operation, and the air-conditioning apparatus 1 is operated in the heating main operation. In FIG. 3, full-line arrows indicate a main refrigerant flow direction in the heating main operation, a dotted-line arrow indicate a refrigerant flow direction mainly related to cooling, and an alternate long and short dash line indicates a water flow direction.

The first solenoid valves 108A connected to the indoor unit C are closed and the first solenoid valves 108A connected to the indoor unit D are opened. The second solenoid valves 108B connected to the indoor unit C are opened and the second solenoid valves 108B connected to the indoor unit D are closed. The opening degree of the second flow control device 113 is controlled so that the difference between a pressure detected by the third pressure detecting device 130A and a pressure detected by the fourth pressure detecting device 130B is a proper value.

Refrigerant flows will be described. As indicated by the full-line arrows, the high temperature, high pressure gas refrigerant, compressed and discharged by the compressor 101, passes through the four-way valve 102, the check valve 120, and the second connecting pipe 107, and is then supplied to the gas-liquid separator 112 in the relay unit B. The gas-liquid separator 112 supplies the high temperature, high pressure gas refrigerant to the merging unit 135A. The gas refrigerant that has been supplied to the merging unit 135A passes through the opened second solenoid valves 108B and the first connecting pipes 106C, and is then supplied to the indoor unit C, which is set for the heating operation.

In the indoor unit C, the use-side heat exchangers 105C exchange heat between the refrigerant and, for example, air to be conditioned, so that the supplied gas refrigerant condenses and liquefies. Furthermore, the first flow control devices 109C control the use-side heat exchangers 105C based on the degree of subcooling at the outlets of the use-side heat exchangers 105C. The first flow control devices 109C reduce the pressure of the liquid refrigerant, condensed and liquefied in the use-side heat exchangers 105C, so that the refrigerant turns into intermediate pressure liquid refrigerant having the intermediate pressure between the high pressure and the low pressure. The intermediate pressure liquid refrigerant is allowed to flow into the merging unit 135B.

After that, streams of the liquid refrigerant that have flowed into the merging unit 135B merge into a single stream in the merging unit 135A. The liquid refrigerant resulting from the merging in the merging unit 135A passes through the second heat exchanger 117. At this time, part of the liquid refrigerant that has passed through the second heat exchanger 117 flows through the third flow control device 115 and is reduced in pressure by the third flow control device 115. The pressure-reduced refrigerant flows into the second heat exchanger 117. In the second heat exchanger 117, therefore, the intermediate pressure liquid refrigerant slightly exchanges heat with the low pressure, two-phase gas-liquid refrigerant. The two-phase gas-liquid refrigerant passes through the bypass pipe 114 and then flows into the first connecting pipe 106. On the other hand, the intermediate pressure liquid refrigerant flows into the merging unit 135B, passes through the check valves 131B connected to the indoor unit D, flows through the second connecting pipes 107D, and then flows into the indoor unit D.

After that, the liquid refrigerant that has flowed into the indoor unit D is reduced to the low pressure by the first flow control devices 109D, which are controlled based on the degree of superheat at the outlets of the use-side heat exchangers 105D in the indoor unit D, so that the evaporating temperature of the refrigerant is reduced to a low value. The refrigerant is then supplied to the use-side heat exchangers 105D. In the use-side heat exchangers 105D, the supplied liquid refrigerant having a low evaporating temperature exchanges heat with, for example, air to be conditioned, so that the refrigerant evaporates and gasifies.

The gasified, or the gas refrigerant passes through the first connecting pipes 106D and flows into the merging unit 135A. In the merging unit 135A, the first solenoid valves 108A connected to the indoor unit D are opened. The gas refrigerant that has flowed into the merging unit 135A passes through the first solenoid valves 108A connected to the indoor unit D, flows into the first connecting pipe 106, and merges with the refrigerant flowing through the bypass pipe 114.

After that, the two-phase gas-liquid refrigerant resulting from the merging flows to the check valve 121 at a lower pressure than the check valve 119. One of refrigerant components separated in a predetermined way by the gas-liquid separator 123 flows into the heat source unit-side heat exchanger 103, evaporates and gasifies, and then flows into the four-way valve 102. The other one of the refrigerant components passes through the fifth flow control device 124, flows into the accumulator 104, and is then sucked into the compressor 101. Such an operation forms the refrigeration cycles to perform the heating main operation.

At this time, the first connecting pipe 106 is at the low pressure and the second connecting pipe 107 is at the high pressure. The difference in pressure between these pipes causes the refrigerant to flow through the check valves 120 and 121. The refrigerant does not flow through the check valves 118 and 119.

It is assumed that the ratio of the cooling operation capacity to the heating operation capacity has changed at the time of, for example, the cooling main operation during the simultaneous cooling and heating operation in the air-conditioning apparatus 1 with the above-described configuration. When the heating operation capacity in the indoor unit D increases, the refrigerant flowing into the relay unit B has to have high quality. If the heat exchange capacity of the heat source unit-side heat exchanger 103 is fixed, the condensing temperature in the heat source unit-side heat exchanger 103 in the heat source unit A, that is, a high-pressure side pressure would decrease. Such a phenomenon would cause a reduction in liquid pipe temperature detected by the liquid pipe temperature detecting device 133C in the indoor unit C performing the cooling operation. Consequently, the indoor unit C would repeat on/off switching (thermo-on/off switching). The air-conditioning apparatus 1 would accordingly fail to continue the cooling operation. In addition, the decreased condensing temperature would result in a reduction in heating capacity, causing a user of the air-conditioning apparatus 1 to feel uncomfortable.

To prevent the on/off switching of the indoor unit C, a liquid pipe temperature to be detected by the liquid pipe temperature detecting device 133C in the indoor unit D has to be increased to and maintained at a predetermined temperature or higher. In the indoor unit C, however, liquid pipes connected to the use-side heat exchangers 105C may be at different temperatures. In general, the temperatures of the liquid pipes connected to the use-side heat exchangers 105C have to be individually controlled to increase the liquid pipe temperatures. Such control may be complicated.

Furthermore, to secure the heating capacity, the condensing temperature in the heat source unit-side heat exchanger 103, that is, the high-pressure side pressure has to be at a predetermined pressure. The ratio of the cooling operation capacity in the indoor unit C to the heating operation capacity in the indoor unit D determines the flow rate of the refrigerant flowing through the heat source unit-side heat exchanger 103 and the flow rate of the refrigerant bypassing the heat source unit-side heat exchanger 103 through the switching valve 125.

Figure 4:
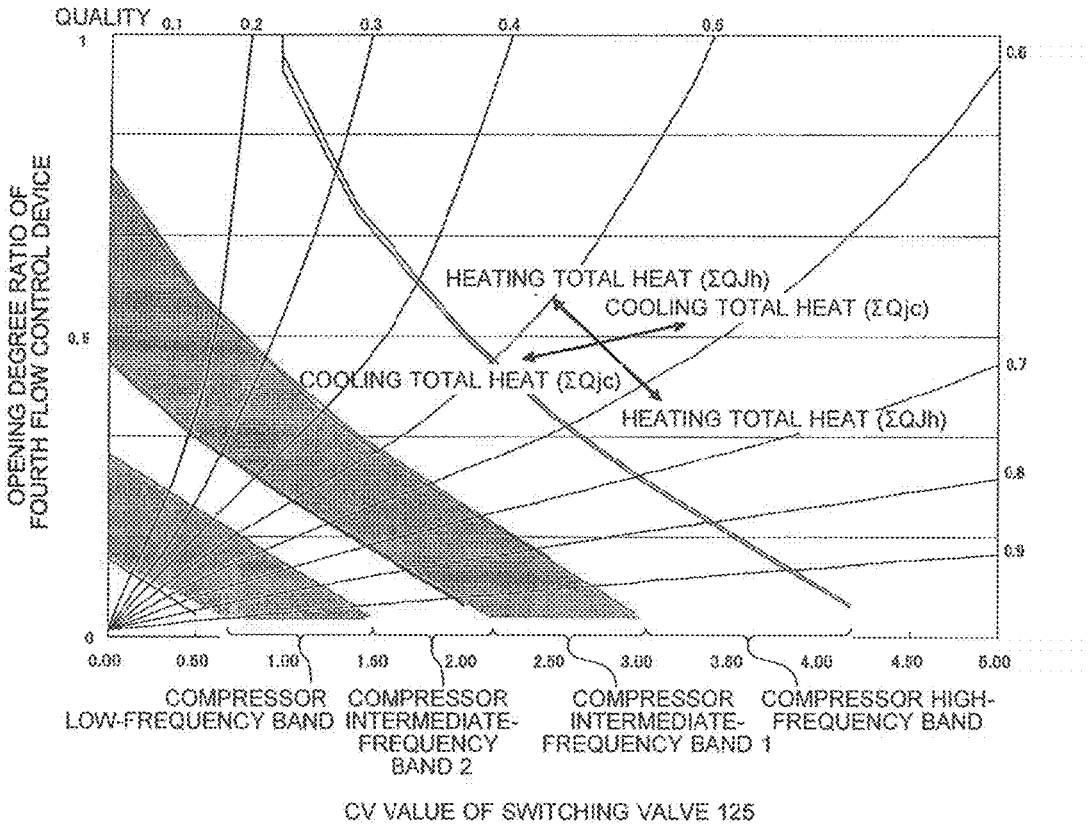
FIG. 4 is a graph illustrating an example of the relationship among the CV value of a switching valve 125, the opening degree ratio of a fourth flow control device 122, and quality during cooling (including the cooling main operation and a cooling only operation) in Embodiment of the present invention.

FIG. 4 is a graph illustrating an example of the relationship among the CV value of the switching valve 125, the opening degree ratio of the fourth flow control device 122, and quality during cooling (including the cooling main operation and the cooling only operation) in Embodiment of the present invention. In FIG. 4, the axis of abscissas indicates the CV value of the switching valve 125 and the axis of ordinates indicates the opening degree ratio of the fourth flow control device 122 controlling the flow rate through the heat source unit-side heat exchanger 103. In addition, ΣQjc denotes the total amount of heat during cooling (cooling total heat) and ΣQjh denotes the total amount of heat during heating (heating total heat). As illustrated in FIG. 4, the relationship between the CV value of the switching valve 125 and the opening degree ratio of the fourth flow control device 122 is broadly classified into four compressor frequency bands.

As described above, when the operation capacity in the indoor unit D is greater than the operation capacity in the indoor unit C in the cooling main operation, a pressure detected by the first pressure detecting device 126 decreases. The quality of the refrigerant has to be increased. When the operation capacity in the indoor unit C is equal to the operation capacity in the indoor unit D, the quality moves on the same line as illustrated in FIG. 4. The frequency of the compressor depends on the cooling total heat ΣQjc. The CV value of the switching valve 125 depends on the heating total heat ΣQjh. The opening degree of the fourth flow control device 122 depends on a pressure detected by the first pressure detecting device 126, a refrigerant inlet temperature related to detection by the inlet temperature detecting device 128 for the heat source unit-side heat exchanger 103, and a refrigerant outlet temperature related to detection by the outlet temperature detecting device 129 for the heat source unit-side heat exchanger 103. In a domain where the flow rate of the refrigerant flowing through the heat source unit-side heat exchanger 103 is high, the degree of subcooling decreases and the quality at an outlet of the heat source unit-side heat exchanger 103 increases. Characteristic lines related to the switching valve 125 accordingly slope upward to the right.

In the above-described case, specifically, control is performed based on the CV value of the switching valve 125, the opening degree ratio of the fourth flow control device 122, and the compressor frequency to reduce the difference between a temperature obtained from a pressure detected by the first pressure detecting device 126 and a target control temperature. It is accordingly unnecessary to determine a target control temperature for each liquid pipe temperature. The control may be performed based on a pressure detected by the first pressure detecting device 126 in the heat source unit A.

This facilitates the control. The simultaneous cooling and heating operation can be stably continued. The above description relates to the case where the operation capacity in the indoor unit D has increased. If the operation capacity in the indoor unit decreases, control can be similarly performed. For example, if the operation capacity in the indoor unit D decreases, a pressure detected by the first pressure detecting device 126 in the heat source unit A will increase. Control that is the opposite of the above-described control may be performed.

Figure 5:
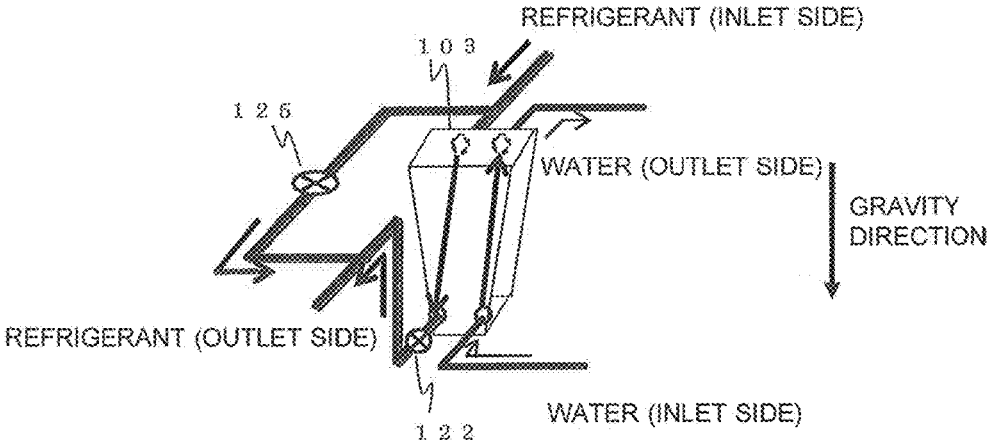
FIG. 5 is a schematic diagram illustrating a refrigerant flow during cooling (including the cooling main operation and the cooling only operation) and elements according to Embodiment of the present invention, with a heat source unit-side heat exchanger 103 being centered.

FIG. 5 is a schematic diagram illustrating a refrigerant flow during cooling (including the cooling main operation and the cooling only operation) and elements according to Embodiment of the present invention, with a heat source unit-side heat exchanger 103 being centered. The heat source unit-side heat exchanger 103 functions as a condenser during cooling. In the Embodiment, while the heat source unit-side heat exchanger 103 is functioning as a condenser, the refrigerant is allowed to flow downward in the direction of gravity (vertical direction). In the air-conditioning apparatus 1 according to the Embodiment, therefore, the heat source unit-side heat exchanger 103 is disposed such that a refrigerant inlet is located above a refrigerant outlet.

In this arrangement where the heat source unit-side heat exchanger 103 is disposed such that the refrigerant inlet is located above the refrigerant outlet during cooling, for example, if the flow rate of the refrigerant flowing through the heat source unit-side heat exchanger 103 decreases because the refrigerant bypasses the heat source unit-side heat exchanger 103 through the bypass pipe 136, no liquid head would occur. Accordingly, an adjustable range of the condensing temperature in the heat source unit-side heat exchanger 103 can be increased, thus increasing efficiency.

Figure 6:
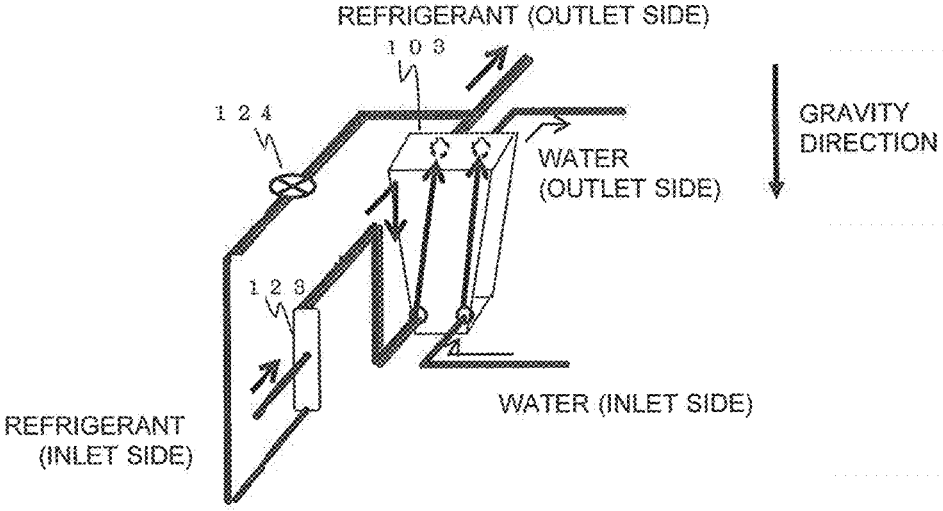
FIG. 6 is a schematic diagram illustrating a refrigerant flow during heating (including the heating main operation and the heating only operation) and other elements according to Embodiment of the present invention with the heat source unit-side heat exchanger 103 being centered.

FIG. 6 is a schematic diagram illustrating a refrigerant flow during heating (including the heating main operation and the heating only operation) and other elements according to Embodiment of the present invention with the heat source unit-side heat exchanger 103 being centered. The heat source unit-side heat exchanger 103 functions as an evaporator during heating. In the Embodiment, while the heat source unit-side heat exchanger 103 is functioning as an evaporator, the refrigerant is allowed to flow upward in the gravity direction. In the air-conditioning apparatus 1 according to the Embodiment, therefore, the heat source unit-side heat exchanger 103 is disposed such that the refrigerant outlet is located above the refrigerant inlet.

In this arrangement where the heat source unit-side heat exchanger 103 is disposed such that the refrigerant outlet is located above the refrigerant inlet during heating, for example, the refrigerant and the water, as a medium, flow parallel to each other in the heat source unit-side heat exchanger 103. The gas-liquid separator 123 is disposed on a refrigerant inlet side of the heat source unit-side heat exchanger 103. The fifth flow control device 124 controls the flow rate of the liquid refrigerant flowing into the heat source unit-side heat exchanger 103. Consequently, the quality of the refrigerant merged with the refrigerant subjected to heat exchange in the heat source unit-side heat exchanger 103 can be controlled, thus controlling the heat exchange capacity. Since the refrigerant inlet is located below the refrigerant outlet, the refrigerant flows in a direction opposite to the gravity direction, thus eliminating unevenness of the refrigerant. This may improve the efficiency of heat exchange.

As described above, the fourth flow control device 122 for controlling the flow rate through the heat source unit-side heat exchanger 103 in the heat source unit A and the switching valve 125 for bypassing the heat source unit-side heat exchanger 103 are arranged, and the fourth flow control device 122 and the switching valve 125 in the simultaneous cooling and heating operation (the cooling main operation) are controlled based on, for example, a pressure detected by the first pressure detecting device 126 in the heat source unit A. Consequently, stable control can be easily performed if one or more use-side heat exchangers 105 are operating for each of the cooling operation and the heating operation. Thus, comfort can be maintained at a low cost.

As described above, the control unit 141 in the air-conditioning apparatus 1 according to the Embodiment obtains a target control temperature for the heat source unit-side heat exchanger based on a pressure at the refrigerant inlet of the heat source unit-side heat exchanger 103, an inlet temperature and an outlet temperature of the water passing through the heat source unit-side heat exchanger 103, and the ratio of the cooling operation capacity to the heating operation capacity of the use-side heat exchangers. The fourth flow control device 122 and the switching valve are controlled based on the target control temperature, thus controlling the flow rate through the heat source unit-side heat exchanger. This facilitates control for the cooling operation or the heating operation if the multiple use-side heat exchangers perform the cooling operation in the simultaneous cooling and heating operation. Such a configuration enables the simultaneous cooling and heating operation to be stably continued at a low cost.

REFERENCE SIGNS LIST

A; heat source unit; B: relay unit; C, la indoor unit; 1: air-conditioning apparatus; 101: compressor; 102: four-way valve; 103: heat source unit-side heat exchanger; 104: accumulator; 105, 105C, 105D: use-side heat exchanger; 106, 106C, 106D: first connecting pipe; 107, 107C, 107D: second connecting pipe; 108A: first solenoid valve; 108B: second solenoid valve; 109C, 109D: first flow control device; 112: gas-liquid separator; 113; second flow control device; 114: bypass pipe; 115: third flow control device; 116: first heat exchanger; 117: second heat exchanger; 118, 119, 120, 121; check valve; 122; fourth flow control device; 123: gas-liquid separator; 124: fifth flow control device; 125: switching valve; 126: first pressure detecting device; 127: second pressure detecting device; 128: inlet temperature detecting device; 129: outlet temperature detecting device; 130A: third pressure detecting device; 130B; fourth pressure detecting device; 131A, 131B: check valve; 132: relay unit temperature detecting device; 133C, 133D: liquid pipe temperature detecting device; 134C, 134D; gas pipe temperature detecting device; 135A, 135B: merging unit; and 141, 151: control unit.

The invention claimed is:

1. An air-conditioning apparatus comprising:

an outdoor unit including a compressor compressing and discharging refrigerant, a heat source unit-side heat exchanger exchanging heat between the refrigerant and a medium, and a four-way valve switching between refrigerant passages;

a plurality of indoor units each including a plurality of use-side heat exchangers exchanging heat between the refrigerant and air to be conditioned and an indoor expansion device reducing a pressure of the refrigerant;

a relay unit connected between the outdoor unit and the indoor units, the relay unit providing a passage through which gas refrigerant is supplied to at least one indoor unit performing heating of the indoor units and a passage through which liquid refrigerant is supplied to at least one indoor unit performing cooling of the indoor units, the outdoor unit, the plurality of indoor units, and the relay unit being connected by pipes to form a refrigerant circuit;

a heat-source-unit flow control valve regulating a flow rate of the refrigerant flowing into the heat source unit-side heat exchanger while the heat source unit-side heat exchanger functions as a condenser;

a bypass pipe allowing the refrigerant to bypass the heat source unit-side heat exchanger;

a switching valve regulating the flow rate of the refrigerant passing through the bypass pipe; and a controller configured to control the heat-source-unit flow control valve and the switching valve based on a pressure on a refrigerant inlet side of the heat source unit-side heat exchanger, which is functioning as the condenser, an inlet temperature and an outlet temperature of the medium passing through the heat source unit-side heat exchanger, and a ratio of a cooling operation capacity to a heating operation capacity of the use-side heat exchangers, wherein the controller is configured to control the heat-source unit flow control valve and the switching valve during a time when at least one of the indoor units is performing heating and another of the indoor units is performing cooling and when the heat-source unit-side heat exchanger functions as the condenser, to vary the flow rate through the heat source unit-side heat exchanger and through the bypass pipe based on a ratio of a cooling operation capacity to a heating operation capacity of the use-side heat exchangers, and wherein at least the switching valve is controlled to have various opening degrees that are less than a fully open degree and greater than a fully closed degree.

2. The air-conditioning apparatus of claim 1, wherein while the heat source unit-side heat exchanger functions as the condenser, a refrigerant inlet of the heat source unit-side heat exchanger is located above a refrigerant outlet of the heat source unit-side heat exchanger in a gravity direction, and a medium inlet of the heat source unit-side heat exchanger is located below a medium outlet of the heat source unit-side heat exchanger in the gravity direction, and wherein the heat-source-unit flow control valve is disposed on a refrigerant outlet side of the heat source unit-side heat exchanger.

3. The air-conditioning apparatus of claim 1, wherein the controller is configured to obtain a temperature difference between a target control temperature for the heat source unit-side heat exchanger and a medium temperature difference between the inlet temperature and the outlet temperature of the medium passing through the heat source unit-side heat exchanger, and obtain a refrigerant temperature in the heat source unit-side heat exchanger based on the ratio of the cooling operation capacity to the heating operation capacity of the use-side heat exchangers and the pressure on the refrigerant inlet side of the heat source unit-side heat exchanger to control the heat-source-unit flow control valve.

4. The air-conditioning apparatus of claim 1, wherein the controller is configured to control an opening degree of the heat-source-unit flow control valve and then control switching of the switching valve.

5. An air-conditioning apparatus comprising:

an outdoor unit including a compressor that compresses and discharges refrigerant, a heat source unit-side heat exchanger that exchanges heat between the refrigerant and a medium, and a four-way valve that switches between refrigerant passages;

a plurality of indoor units, each including a plurality of use-side heat exchangers that exchange heat between the refrigerant and air to be conditioned; and an indoor expansion device that reduces a pressure of the refrigerant;

a relay unit connected between the outdoor unit and the indoor units, wherein the relay unit provides a passage through which gas refrigerant is supplied to at least one indoor unit of the indoor units that performs heating and a passage through which liquid refrigerant is supplied to at least one indoor unit of the indoor units that performs cooling, and wherein the outdoor unit, the plurality of indoor units, and the relay unit are connected by pipes to form a refrigerant circuit;

a gas-liquid separator located between the relay unit and the heat source unit-side heat exchanger, wherein the gas-liquid separator separates the refrigerant flowing toward the heat source unit-side heat exchanger into gas refrigerant and liquid refrigerant at a time when at least one of the indoor units is performing heating, another of the indoor units is performing cooling, and the heat source unit-side heat exchanger functions as an evaporator;

an accumulator provided on a suction side of the compressor, a heat-source-unit flow control valve located between the accumulator and the gas-liquid separator; and a controller configured to control the heat-source-unit flow control valve to control the flow rate of the liquid refrigerant flowing through the heat source unit-side heat exchanger by regulating a flow rate of the liquid refrigerant bypassing the heat source unit-side heat exchanger, during the time when at least one of the indoor units is performing heating, another of the indoor units is performing cooling, and the heat source unit-side heat exchanger functions as the evaporator, and wherein one refrigerant component that is separated by the gas-liquid separator flows into the heat source unit-side heat exchanger and another refrigerant component that is separated by the gas-liquid separator flows through the heat source-unit flow control valve to an inlet side of the compressor.

6. The air-conditioning apparatus of claim 5, wherein while the heat source unit-side heat exchanger functions as the evaporator, a refrigerant outlet of the heat source unit-side heat exchanger is located above a refrigerant inlet of the heat source unit-side heat exchanger in a gravity direction, and a medium inlet of the heat source unit-side heat exchanger is located below a medium outlet of the heat source unit-side heat exchanger in the gravity direction.

7. The air-conditioning apparatus of claim 5, wherein the controller is configured to obtain a temperature difference between a target control temperature for the heat source unit-side heat exchanger and a medium temperature difference between the inlet temperature and the outlet temperature of the medium passing through the heat source unit-side heat exchanger, and obtain a refrigerant temperature in the heat source unit-side heat exchanger based on the ratio of the cooling operation capacity to the heating operation capacity of the use-side heat exchangers and the pressure on the refrigerant inlet side of the heat source unit-side heat exchanger to control the heat-source-unit flow control valve.

* * * * *